US006389976B1

(12) United States Patent
Zacharin

(10) Patent No.: US 6,389,976 B1
(45) Date of Patent: May 21, 2002

(54) HARD TARGET FUZE

(75) Inventor: Alexey Zacharin, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/780,383

(22) Filed: Feb. 12, 2001

Related U.S. Application Data

(60) Provisional application No. 60/202,646, filed on May 8, 2000, and provisional application No. 60/226,078, filed on Aug. 17, 2000.

(51) Int. Cl.[7] ..... F42C 15/34

(52) U.S. Cl. ..... 102/259; 102/258; 102/254; 102/256

(58) Field of Search ..... 102/254, 256, 102/258–259, 221–222, 226–227, 229–230

(56) References Cited

U.S. PATENT DOCUMENTS 2,828,691 A * 4/1958 Webster ..... 102/258
2,960,037 A * 11/1960 Raech et al. ..... 102/259
3,724,385 A * 4/1973 Beatty et al. ..... 102/229
4,573,411 A * 3/1986 Liebhardt et al. ..... 102/254
4,679,503 A * 7/1987 Rudenauer et al. ..... 102/254
5,275,107 A * 1/1994 Weber et al. ..... 102/229

FOREIGN PATENT DOCUMENTS

DE 2709396 * 9/1978 ..... 102/259
GB 2025005 a * 1/1980 ..... 102/256

* cited by examiner

*Primary Examiner*—Michael J. Carone
*Assistant Examiner*—Lulit Semunegus
(74) *Attorney, Agent, or Firm*—John F. Moran

(57) ABSTRACT

A safe-and-arm device for a projectile fired from a smooth bore gun has a rotor that rotates between a safe position and armed position. A setback sensor retains the rotor in the safe position until an acceleration of the projectile causes the setback sensor to be repositioned. Once the setback sensor is repositioned, a bore rider is released and a rotor spring rotates the rotor to arm the projectile.

20 Claims, 2 Drawing Sheets

HARD TARGET FUZE

RELATED APPLICATIONS

This application claims benefit of filing date May 8, 2000 of provisional application No. 60/202,646, and also of Aug. 17, 2000 of provisional application No. 60/226,078, the entire file wrapper contents of both which applications are herewith incorporated by reference as though fully set forth herein at length.

GOVERNMENT INTEREST

The inventions described herein may be manufactured, used and licensed by or for the U.S. Government for U.S. Government purposes.

BACKGROUND OF THE INVENTION

1. Field of the Invention

This invention relates to kinetic energy penetrator projectiles. In particular, the kinetic energy penetrator projectiles utilize explosive or propelling charges. Most particularly, the kinetic energy penetrator projectiles comprise a safe-and-arm mechanism for a fuze that initiates the charge in a safe and efficient manner.

2. Brief Description of the Related Art

Kinetic energy projectiles have been used to destroy a target from the impact of the projectile with the target. Commonly used safe-and-arm devices found in spinning projectiles are not useful in smooth bore weapons which do not impart a spin component onto the fired projectile. Diameter limitations and extreme acceleration forces found in smooth bore weapons render cross use of these systems impractical.

The absence of reliable safe-and-arm devices for kinetic energy devices complicates handling and storage of kinetic energy devices that incorporate an explosive component thereon. As such, advances in the combination of kinetic energy projectiles with explosive components have been limited.

In view of the foregoing, there is a need for improvements in safe-and-arm devices for kinetic energy projectiles having an explosive or propelling charge. The present invention addresses this and other needs.

SUMMARY OF THE INVENTION

The present invention includes a safe-and-arm device for a projectile fired from a smooth bore gun, comprising a fuze housing, a rotor within the fuze housing, the rotor having a first rotational position and a second rotational position, wherein the rotor is retained in the first rotational position by a setback sensor, a rotor spring having a tensioned state bearing against the rotor while the rotor remains in the first rotational position wherein the rotor spring exerts a force onto the rotor sufficient to rotate the rotor to a second rotational position, the setback sensor holding the rotor in the first rotational position with the setback sensor interconnected between the fuze housing and rotor wherein the setback sensor retains the rotor in the first rotational position in opposition to the tensioned state of the rotor spring, a bore rider extending through the fuze housing that is positionally fixed against the rotational movement of the rotor, a retaining device causing a bearing force against the bore rider sufficient to retain the bore rider within the fuze housing, a bore rider spring tensionally compressed within the retained bore rider wherein the bore rider spring connected to the bore rider remains capable of ejecting the bore rider from within the projectile absent a bearing force against the bore rider, a shear pin pinning the setback sensor while the setback sensor holds the rotor in the first rotational position and an explosive train having at least two sections, wherein the first rotational position of the rotor interrupts the explosive train and the second rotational position of the rotor enables the explosive train.

The present invention also includes an armed projectile product produced by the process comprising the steps of providing a safe-and-arm device for a projectile fired from a smooth bore gun comprising a fuze housing, a rotor within the fuze housing, the rotor having a first rotational position and a second rotational position wherein the rotor is retained in the first rotational position by a setback sensor, a rotor spring having a tensioned state bearing against the rotor while the rotor remains in the first rotational position wherein the rotor spring exerts a force onto the rotor sufficient to rotate the rotor to a second rotational position, the setback sensor holding the rotor in the first rotational position with the setback sensor interconnected between the fuze housing and rotor wherein the setback sensor retains the rotor in the first rotational position in opposition to the tensioned state of the rotor spring, a bore rider extending through the fuze housing that is positionally fixed against the rotational movement of the rotor, a retaining device causing a bearing force against the bore rider sufficient to retain the bore rider within the fuze housing, a bore rider spring tensionally compressed within the retained bore rider wherein the bore rider spring connected to the bore rider remains capable of ejecting the bore rider from within the projectile absent a bearing force against the bore rider, a shear pin pinning the setback sensor while the setback sensor holds the rotor in the first rotational position and an explosive train having at least two sections wherein the first rotational position of the rotor interrupts the explosive train and the second rotational position of the rotor enables the explosive train and firing the projectile from the smooth bore gun wherein the setback sensor upon reaching a selected shear acceleration force shears the shear pin and moves to an aft position in the fuze housing which permits release of the bore rider allowing the rotor to rotate and enable the explosive train.

Additionally, the present invention includes a method for arming a projectile fired from a smooth bore gun comprising the steps of providing a safe-and-arm device for a projectile fired from a smooth bore gun comprising a fuze housing, a rotor within the fuze housing, the rotor having a first rotational position and a second rotational position wherein the rotor is retained in the first rotational position by a setback sensor, a rotor spring having a tensioned state bearing against the rotor while the rotor remains in the first rotational position wherein the rotor spring exerts a force onto the rotor sufficient to rotate the rotor to a second rotational position, the setback sensor holding the rotor in the first rotational position with the setback sensor interconnected between the fuze housing and rotor wherein the setback sensor retains the rotor in the first rotational position in opposition to the tensioned state of the rotor spring, a bore rider extending through the fuze housing that is positionally fixed against the rotational movement of the rotor, a retaining device causing a bearing force against the bore rider sufficient to retain the bore rider within the fuze housing, a bore rider spring tensionally compressed within the retained bore rider wherein the bore rider spring connected to the bore rider remains capable of ejecting the bore rider from within the projectile absent a bearing force against the bore rider, a shear pin pinning the setback sensor while the setback sensor holds the rotor in the first rotational position and an explosive train having at least two sections wherein the first rotational position of the rotor interrupts the explosive train and the second rotational position of the rotor enables the explosive train and firing the projectile from the smooth bore gun wherein the setback sensor upon reaching a selected shear acceleration force shears the shear pin and moves to an aft position in the fuze housing which permits release of the bore rider allowing the rotor to rotate and enable the explosive train.

Other and further advantages of the present invention are set forth in the description and appended claims.

DETAILED DESCRIPTION OF THE PREFERRED EMBODIMENTS

The present invention includes a fuze mechanism for kinetic energy penetrator projectiles having explosive or propelling charges. The fuze mechanism provides a safe-and-arm mechanism for the charge within the kinetic energy penetrator projectiles for safe operation when fired from a smooth bore gun. The present invention is readily suited for use in appropriately sized kinetic energy projectiles, particularly 20 mm and other such sized projectiles.

Figure 1:
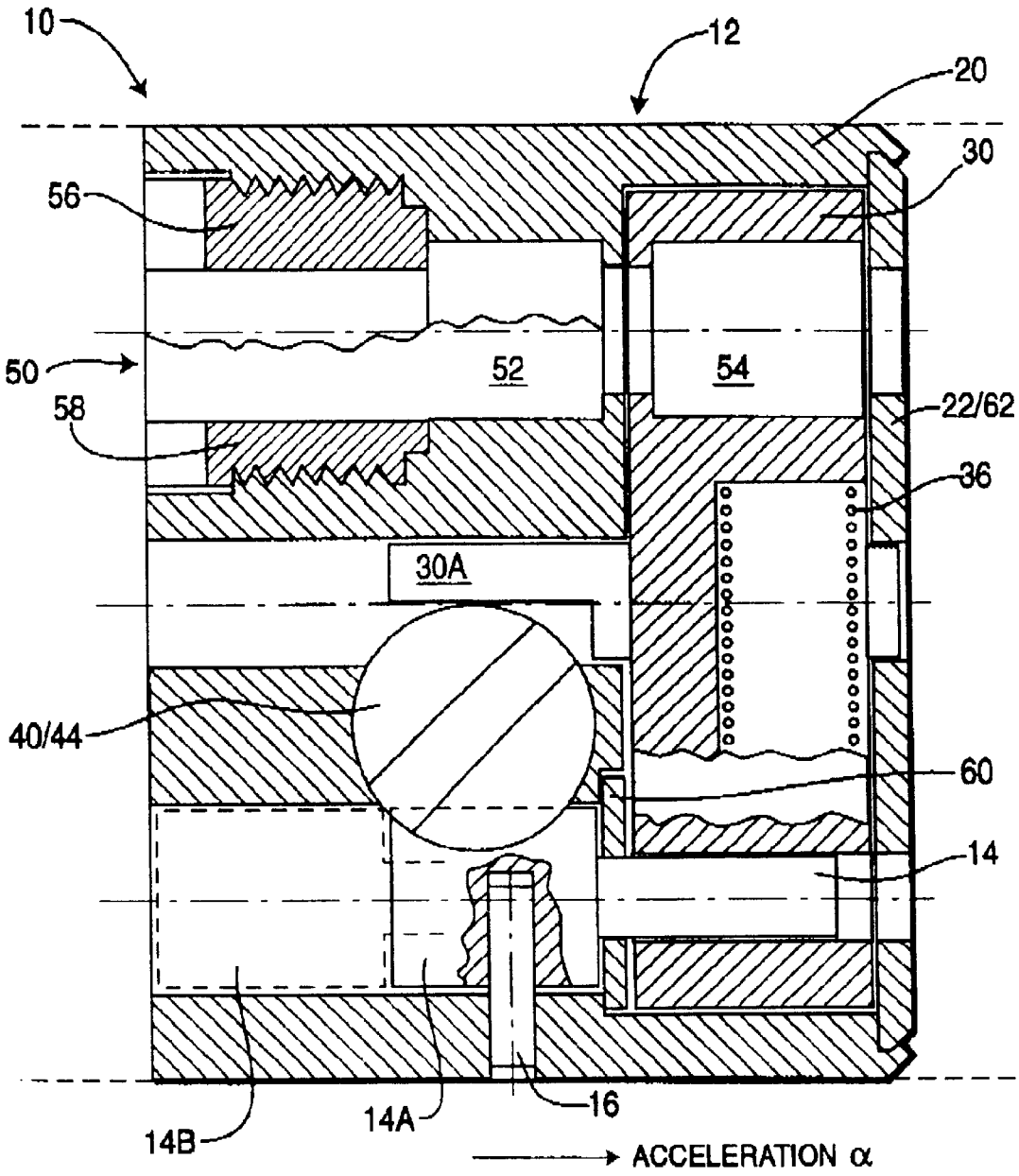
FIG. 1 illustrates a cross-sectional view of the present invention.

As seen in FIG. 1, a kinetic energy projectile 10 of the present invention comprises a safe-and-arm device 12 for arming the projectile a safe distance from a smooth bore gun. The safe-and-arm device 12 includes a fuze housing 20 that encloses a rotor 30 mechanism and bore rider 40. The safe-and-arm device 12 allows firing of a smooth bore projectile containing an explosive component in a safe manner.

The rotor 30 of the kinetic energy projectile 10 rotates and aligns at least one part of an explosive train 50 into a detonation position within the projectile 10. The rotor 30 includes any suitable configuration for proper rotation within a projectile 10, with rotation preferably outside of the line of travel $\alpha$, i.e., acceleration, of the projectile 10, and more preferably at a angle of 90 degrees from the line of travel $\alpha$ of the projectile 10. Preferably the rotor 30 is configured in a substantially circular circumference that maximizes the area of the rotor 30 when positioned in cross-sectional placement within the fuze housing 20. The rotor 30 has at least two fixed positions within a rotational arc which include a first rotational position 32 and a second rotational position 34, shown in FIG. 2. The first rotational position 32 mis-aligns or interrupts the explosive train 50 sufficiently to render the projectile 10 containing a charge safe for handling and storage. Movement of the rotor 30 to the second rotational position 34 aligns the explosive train 50 to an armed configuration. When the rotor 30 remains in the first rotational position 32, the explosive train 50 remains interrupted or dis-enabled, and when the rotor 30 moves to the second rotational position 34, the explosive train 50 becomes enabled.

A rotor spring 36 moves the rotor 30 from the first rotational position 32 to the second rotational position 34. The rotor spring 36 is placed in a tensioned state bearing against the rotor 30 while the rotor 30 remains in the first rotational position 32. Preferably, the tensioned rotor spring 36 results from compression of the rotor spring 36. In this position, the rotor spring 36 exerts a force onto the rotor 30 sufficient to rotate the rotor 30 to the second rotational position 34. However, the rotor 30 is held against the force of the rotor spring 36 with a setback sensor 14 and bore rider 40. Rotation of the rotor 30 between the first rotational position 32 and the second rotational position 34 comprises an arc in an amount that is sufficient to provide safe arming, with the proper rotational amount being determinable by those skilled in the art for a given purpose. Preferably, the rotor 30 rotates an arc of approximately 90 degrees. Preferably, a barrier or other type of stopping surface stops the rotation of the rotor 30 at the second rotational position 34 as the rotor 30 is rotated from the first rotational position 32.

The setback sensor 14 is used to retain the rotor 30 in the first rotational position 32 in opposition to the force exerted by the rotor spring 36. The setback sensor 14 holds the rotor 30 in the first rotational position 32 by interconnecting the fuze housing 20 and rotor 30, thereby giving a fixed resistance to the applied force of the rotor spring 36. The setback sensor 14 retains the rotor 30 in the first rotational position 32 in opposition to the tensioned state of the rotor spring 36, and comprises a resistance sufficient to withstand the compression force of the rotor spring 36 to retain the rotor 30 in a safe position fixed to the fuze housing 20. As seen in FIG. 1 the setback sensor 14 is located and held in a forward position 14A with a shear pin 16. Acceleration of the projectile 10 causes sufficient force for the setback sensor 14 to shear the shear pin 16 and move to an aft position 14B. With movement to the aft position 14B, the setback sensor 14 is removed from the arc of movement of the rotor 30, which allows the rotor 30 to move once the bore rider 40 has been dislocated.

Figure 2:
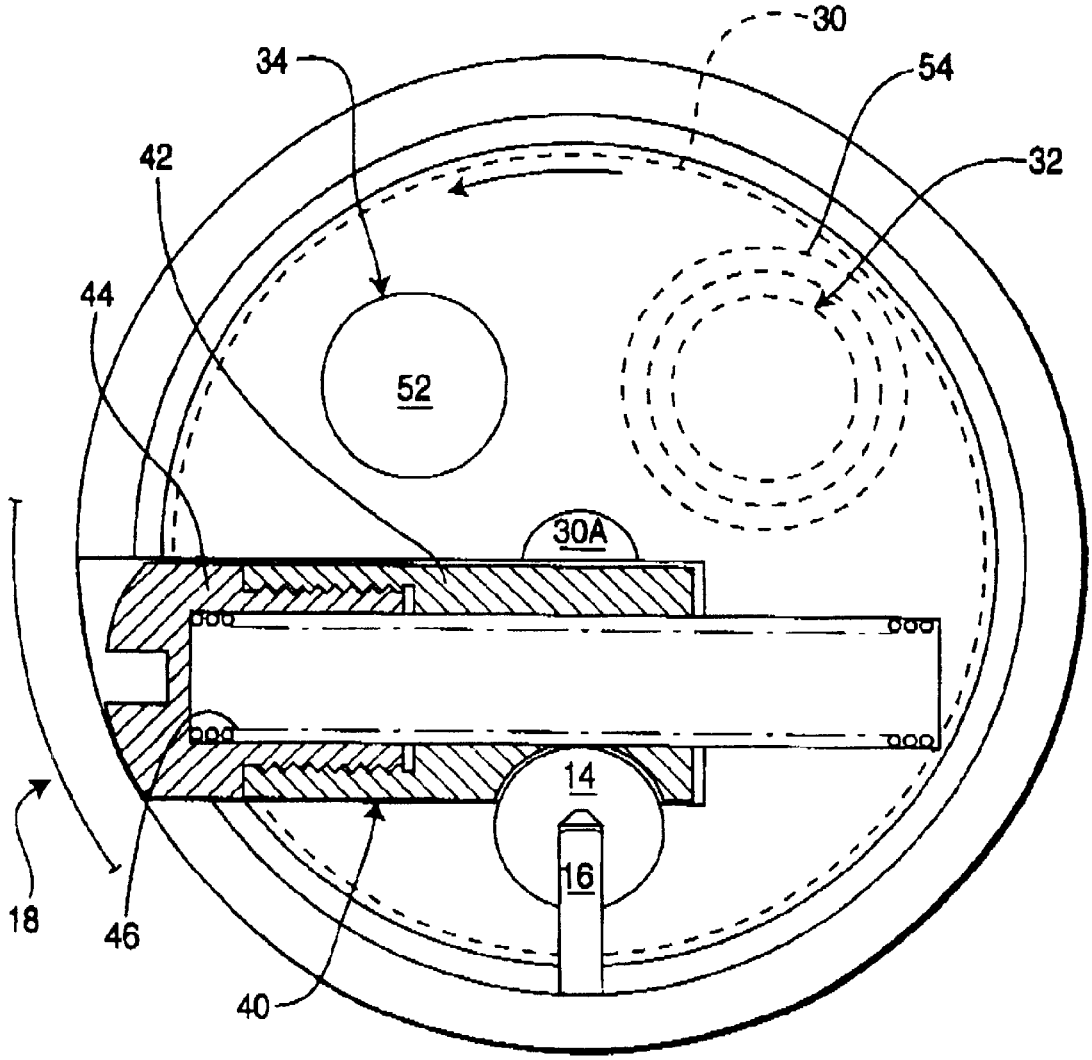
FIG. 2 illustrates a front-to-back axial view of the bore rider, shear pin and explosive train of the present invention showing the operational orientation of a first and second rotational position.

The shear pin 16, shown in FIGS. 1 and 2, pins the setback sensor 14 while the setback sensor 14 holds the rotor 30 in the first rotational position 32. The shear pin 16 is fixed in place by the fuze housing 20 to ensure non-movement of the shear pin 16. The shear pin 16 is calibrated to shear or fail at a predetermined forces applied to it from the setback sensor 14, with the proper amount of force necessary to cause the shear pin 16 to fail being determinable by those skilled in the art. The shear pin 16 pins the setback sensor 14 in the its forward safe position 14A prior to the projectile 10 being fired. Once the projectile 10 is fired and accelerated, the setback sensor 14 becomes forced against the shear pin 16, causing the shear pin 16 to fail. Once sheared, the shear pin 16 is cleared from the path of the setback sensor 14, allowing the setback sensor 14 to locate to its aft position 14B.

Referring to the axial view of the present invention represented in FIG. 2, the bore rider 40 of the present invention extends through the fuze housing 20. Preferably the bore rider 40 comprises a bore rider lock 42 that imposes a barrier to fuze arming. The bore rider lock 42 physically interrupts the movement of the aft section 30A of the rotor 30, as well as the back part of the setback sensor 14. This places the bore rider lock 42 positionally fixed against the rotational movement of the rotor 30. The bore rider 40 further comprises a bore rider cap 44 that secures the bore rider spring 46 within the bore rider lock 42. Any suitable connection between the bore rider cap 44 and the bore rider lock 42 may be used to attach the two components together, such as a clipping mechanism, screwing mechanism or other like mechanical connections which allows easy insertion of the bore rider 40 into the projectile 10. Most preferably, the bore rider cap 44 screws onto the bore rider lock 42 with the bore rider spring 46 attached to the bore rider cap 44. Having the bore rider spring 46 attached to the bore rider cap 44 allow efficient ejection of the bore rider spring 46 from the projectile 10 along with the bore rider 40. The bore rider cap 44 becomes contained within the projectile 10 by an external bearing or retaining force that is sufficient to retain the bore rider 40 within the fuze housing 20, with such external bearing force preferably comprising a sabot 18.

The bore rider spring 46 is tensionally compressed within the bore rider 40 retained within the projectile 10. The bore rider spring 46 imparts a force onto the bore rider cap 44 that ejects the bore rider cap 44, along with the bore rider lock 42, when the external bearing force is removed from the bore rider cap 44. The two component parts of the bore rider 40, i.e., the bore rider cap 44 and bore rider lock 42, allow the bore rider 40 to be placed within the projectile 10 just prior to the attachment of the sabot 18 and thereafter efficiently maintained.

Both the setback sensor 14 and bore rider 40 hold the rotor 30 in the first rotational position 32, giving the safe-and-arm device 12 a redundancy in safe arming while permitting an ease in assembly of the safe-and-arm device 12 into the projectile 10. The setback sensor 14 interconnects between the fuze housing 20 and rotor 30 to retain the rotor 30 in the first rotational position 32 in opposition to the tensioned state of the rotor spring 36. The bore rider 40, extending through the fuze housing 20 and positionally fixed against the rotational movement of the rotor 30, releases when the retaining force against the bore rider 40 becomes sufficiently negligible or absent. This allows the bore rider spring 46, that is tensionally compressed within the retained bore rider 40, to eject the bore rider 40 from within the projectile 10.

The explosive train 50 of the present invention comprises at least two sections or segments 52 and 54 which are rotationally alignable with the rotor 30. When the rotor 30 is fixed in the first rotational position 32 of the rotor 30, the at least two sections 52 and 54 are physically separated to interrupt the two sections 52 and 54 from forming the explosive train 50 capable of detonation. The two sections 52 and 54 comprise at least one lead and at least detonator, with section 52 being the lead when section 54 comprises the detonator, or with section 52 being the detonator when the section 54 comprises the lead. As such, the explosive train 50 may fire in a forward or aft sequence, with the proper direction of firing determinable by those skilled in the art for a given purpose. As such, possible configurations of the explosive train 50 having the detonator in axial alignment with the lead in the second rotational position 34 include the detonator located outside of the rotor 30 and the lead is located within the rotor 30, the detonator located within the rotor 30 and the lead located outside of the rotor 30, and other such configurations as determinable by those skilled in the art.

The explosive train 50 becomes enabled with the exits of the projectile 10 from the bore of a gun. As the projectile 10 is accelerated within the barrel of the gun, the acceleration force causes the setback sensor 14 to move aft which moves the setback sensor 14 out of the "safe" position. Additionally with the projectile's exits from the gun barrel, the sabot 18 disengages and the bore rider 40 is ejected from the projectile 10 which removes the bore rider 40 from rendering the fuze in a safe position. Accelerations required for shearing the shear pin 16 are determinable by those skilled in the art in light of the type of projectile 10 used, with preferred accelerations or ballistic environments attained by the projectile 10 being from about 30,000 g's or more, preferably from about 30,000 g's to about 100,000 g's. Arming times are variable dependent on when the sabot 18 disengages and when the bore rider 40 becomes ejected from the projectile 10, with arming times of from about 100 microseconds or less desirable, such as from about 10 microseconds to about 30 microseconds. The bore rider 40 becomes ejected from the projectile 10 at distances from the gun muzzle being any suitable distance for safe arming as determinable by those skilled in the art in light of the disclosure herein, with preferred distances being from about 2 feet to about 60 feet, more preferred distances being from about 2 feet to about 30 feet, and most preferred distances being from about 2 feet to about 15 feet.

As further seen in FIG. 2, the safe-and-arm device comprises a lock nut 60 adjacent to the setback sensor 14. The lock nut 60 locks the setback sensor 14 in its aft position after the setback sensor 14 moves with the firing of the projectile 10. Preferably the lock nut 60 comprises a sliding wall mechanism that remains agar against the setback sensor 14, and falls into place once the setback sensor 14 has moved aft to prevent disengagement of the setback sensor 14 into its forward position.

The safe-and-arm device 12 of the present invention may further comprises a safe-and-arm indicator 62 visible through a cover 22. The safe-and-arm indicator 62 may be any appropriate indication of the arming status of the projectile 10, with selection of the proper indicator 62 design and type determinable by those skilled in the art.

When placed within a kinetic energy projectile 10, the safe-and-arm device 12 may be mounted at any suitable position within the projectile 10. Suitable positions include the tail section, nose section and/or middle section of the projectile 10 with proper selection of the positioning of the safe-and-arm device 12 within the projectile 10 being determinable by those skilled in the art.

In operation, the previously described projectile 10 becomes armed with the firing of the projectile 10 from a smooth bore gun. As the projectile 10 is fired, an acceleration force forces the setback sensor 14, which is holding the rotor 30 in the first rotational position 32, aft and away from the forward position 14A in a manner forceful enough such that the setback sensor 14 reaches a selected shear acceleration force, causing the setback sensor 14 to shear the shear pin 16. With the shearing of the shear pin 16, the setback sensor 14 moves to the aft position 14B along the line of travel $\alpha$ of the projectile 10. This clears the arc of movement of the rotor 30. Concurrently, the bore rider 40 that is positionally fixed against the rotational movement of the rotor 30 becomes ejected from the projectile 10 after the exist of the fired projectile 10 from the smooth bore gun. As the projectile 10 exists from the gun, the sabot 18 falls from the accelerated projectile 10 which releases the bearing force against the tensionally compressed bore rider spring 46. This allows the bore rider spring 46 to eject the bore rider 40 from the projectile 10, which removes the bore rider 40 from interfering with rotational movement of the rotor 30. With the removal of the setback sensor 14 and bore rider 40 from inhibiting the rotational movement of the rotor 30, the rotor responds the force of the rotor spring 36. This permits the rotor 30 to rotate in response to the force applied to the rotor 30 by the tensioned state of the rotor spring 36. With rotation of the rotor 30, the rotor 30 moves from the first rotational position 32 to the second rotational position 34, which enables the explosive train 50.

The present invention provides a method for arming the projectile 10 having duel safety mechanisms for ensuring safe handling and storage of the projectile 10 while permitting easy assemblage of the projectile 10 prior to firing.

The following example is provided to illustrate the use of the present invention on a weapon system. The example is prophetic.

EXAMPLE 1

A 20 mm kinetic energy projectile, with an attached sabot, is fired from a smooth bore gun at a target. Acceleration of the projectile causes the projectile to experience a ballistic environment of approximately 75,000 g's. This ballistic environment causes the setback sensor to shear the shear pin and move to an aft position. At approximately 15 feet from the gun, the sabot has disengaged from the projectile and the bore rider becomes ejected from the projectile. During the next second, the rotor which is now free to rotationally move rotates from a safe position to an armed position. In the armed position, the lead and detonator within the projectile are aligned within an explosive train. On contact of the projectile with the target, the explosive train detonates.

It should be understood that the foregoing summary, detailed description, examples and drawings of the invention are not intended to be limiting, but are only exemplary of the inventive features which are defined in the claims.

What is claimed is:

1. A safe-and-arm device for a projectile fired from a smooth bore gun, comprising:

a fuze housing;

a rotor within the fuze housing, the rotor having a first rotational position and a second rotational position, wherein the rotor is retained in the first rotational position by a setback sensor;

a rotor spring having a tensioned state bearing against the rotor while the rotor remains in the first rotational position, wherein the rotor spring exerts a force onto the rotor sufficient to rotate the rotor to a second rotational position;

the setback sensor holding the rotor in the first rotational position, with the setback sensor interconnected between the fuze housing and rotor, wherein the setback sensor retains the rotor in the first rotational position in opposition to the tensioned state of the rotor spring;

a bore rider extending through the fuze housing that is positionally fixed against the rotational movement of the rotor;

a retaining device causing a bearing force against the bore rider sufficient to retain the bore rider within the fuze housing;

a bore rider spring tensionally compressed within the retained bore rider, wherein the bore rider spring connected to the bore rider remains capable of ejecting the bore rider from within the projectile absent a bearing force against the bore rider;

a shear pin pinning the setback sensor while the setback sensor holds the rotor in the first rotational position; and, an explosive train having at least two sections, wherein the first rotational position of the rotor interrupts the explosive train and the second rotational position of the rotor enables the explosive train.

2. The safe-and-arm device of claim 1, wherein the retaining device comprises a projectile sabot.

3. The safe-and-arm device of claim 1, wherein the bore rider comprises a bore rider lock coupled to a bore rider cap, wherein the bore rider lock intermeshes with the component part of the setback sensor and the bore rider cap holds the tensionally compressed bore rider spring.

4. The safe-and-arm device of claim 1, wherein the rotor rotates between the first rotational position and the second rotational position an amount sufficient to provide safe arming.

5. The safe-and-arm device of claim 4, wherein the rotor rotates approximately 90 degrees.

6. The safe-and-arm device of claim 1, wherein the explosive train comprises a detonator in axial alignment with a lead in the second rotational position.

7. The safe-and-arm device of claim 6, wherein the detonator is located outside of the rotor and the lead is located within the rotor.

8. The safe-and-arm device of claim 6, wherein the detonator is located within the rotor and the lead is located outside of the rotor.

9. The safe-and-arm device of claim 1, further comprising a lock nut adjacent to the setback sensor, wherein the lock nut locks the setback sensor after the setback sensor engages to prevent disengagement of the setback sensor.

10. The safe-and-arm device of claim 1, further comprising a safe-and-arm indicator.

11. The safe-and-arm device of claim 1, wherein the rotor spring comprises a compressed tensioned state in the first rotational position.

12. A kinetic energy projectile comprising the safe-and-arm device of claim 1.

13. The kinetic energy projectile of claim 12, wherein the projectile comprises a tail mounted safe-and-arm device.

14. The kinetic energy projectile of claim 12, wherein the projectile comprises a nose mounted safe-and-arm device.

15. The kinetic energy projectile of claim 12, wherein the projectile comprises the safe-and-arm device mounted within the middle of the projectile.

16. An armed projectile product produced by the process comprising the steps of:

providing a safe-and-arm device for a projectile fired from a smooth bore gun comprising a fuze housing, a rotor within the fuze housing, the rotor having a first rotational position and a second rotational position wherein the rotor is retained in the first rotational position by a setback sensor, a rotor spring having a tensioned state bearing against the rotor while the rotor remains in the first rotational position wherein the rotor spring exerts a force onto the rotor sufficient to rotate the rotor to a second rotational position, the setback sensor holding the rotor in the first rotational position with the setback sensor interconnected between the faze housing and rotor wherein the setback sensor retains the rotor in the first rotational position in opposition to the tensioned state of the rotor spring, a bore rider extending through the fuze housing that is positionally fixed against the rotational movement of the rotor, a retaining device causing a bearing force against the bore rider sufficient to retain the bore rider within the fuze housing, a bore rider spring tensionally compressed within the retained bore rider wherein the bore rider spring connected to the bore rider remains capable of ejecting the bore rider from within the projectile absent a bearing force against the bore rider, a shear pin pinning the setback sensor while the setback sensor holds the rotor in the first rotational position and an explosive train having at least two sections, wherein the first rotational position of the rotor interrupts the explosive train and the second rotational position of the rotor enables the explosive train; and, firing the projectile from the smooth bore gun, wherein the setback sensor upon reaching a selected shear acceleration force shears the shear pin and moves to an aft position in the fuze housing which permits release of the bore rider allowing the rotor to rotate and enable the explosive train.

17. The product of claim 16, wherein the explosive train becomes enabled within the projectile at distance from the gun of from about 2 feet to about 60 feet.

18. A method for arming a projectile fired from a smooth bore gun, comprising the steps of:

providing a safe-and-arm device for a projectile fired from a smooth bore gun comprising a fuze housing, a rotor within the fuze housing, the rotor having a first rotational position and a second rotational position wherein the rotor is retained in the first rotational position by a setback sensor, a rotor spring having a tensioned state bearing against the rotor while the rotor remains in the first rotational position wherein the rotor spring exerts a force onto the rotor sufficient to rotate the rotor to a second rotational position, the setback sensor holding the rotor in the first rotational position with the setback sensor interconnected between the fuze housing and rotor wherein the setback sensor retains the rotor in the first rotational position in opposition to the tensioned state of the rotor spring, a bore rider extending through the fuze housing that is positionally fixed against the rotational movement of the rotor, a retaining device causing a bearing force against the bore rider sufficient to retain the bore rider within the fuze housing, a bore rider spring tensionally compressed within the retained bore rider wherein the bore rider spring connected to the bore rider remains capable of ejecting the bore rider from within the projectile absent a bearing force against the bore rider, a shear pin pinning the setback sensor while the setback sensor holds the rotor in the first rotational position and an explosive train having at least two sections, wherein the first rotational position of the rotor interrupts the explosive train and the second rotational position of the rotor enables the explosive train; and, firing the projectile from the smooth bore gun, wherein the setback sensor upon reaching a selected shear acceleration force shears the shear pin and moves to an aft position in the fuze housing which permits release of the bore rider allowing the rotor to rotate and enable the explosive train.

19. The method of claim 18, wherein the fired projectile attains a ballistic environment of from about 50,000 g's or more.

20. The method of claim 19, wherein the fired projectile attains a ballistic environment of from about 60,000 g's to about 100,000 g's.

* * * * *